US006616485B2

(12) United States Patent
Harasawa et al.

(10) Patent No.: US 6,616,485 B2
(45) Date of Patent: Sep. 9, 2003

(54) CONTACT AND ELECTRIC CONNECTOR ONTO WHICH THE CONTACT IS MOUNTED

(75) Inventors: Masaaki Harasawa, Yokohama (JP); Yozo Tomonari, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/161,597

(22) Filed: Jun. 5, 2002

(65) Prior Publication Data

US 2002/0187666 A1 Dec. 12, 2002

(30) Foreign Application Priority Data

Jun. 8, 2001 (JP) ..... 2001-174895

(51) Int. Cl.[7] ..... H01R 23/70
(52) U.S. Cl. ..... 439/630; 439/862
(58) Field of Search ..... 439/630, 660, 439/852, 862, 637, 636

(56) References Cited

U.S. PATENT DOCUMENTS 4,344,665 A * 8/1982 Racilla et al. ..... 439/399
5,785,557 A * 7/1998 Davis ..... 439/108
6,024,612 A * 2/2000 Myer et al. ..... 439/744
6,102,744 A * 8/2000 Korsunsky et al. ..... 439/637
6,126,496 A * 10/2000 Shinozaki ..... 439/862

* cited by examiner

*Primary Examiner*—Lynn Feild
*Assistant Examiner*—Phuong K T Dinh
(74) *Attorney, Agent, or Firm*—Armstrong, Westerman & Hattori, LLP

(57) ABSTRACT

A contact capable of achieving the reduction of height in the direction of displacement, and of obtaining excellent contact pressure. A contact 10 comprises substantially a belt-like elastic contact member 20 having a terminal 21 at one end and a contact part 27 at the other end and substantially a belt-like elastic protection member 30 having a fixing part 31 at one end and a protecting part 37 at the other end and an accommodation hole 33 provided in the protection member 30 between the fixing part 31 and the protecting part 37, wherein the elastic contact member 20 is spaced from and disposed in parallel with the protection member 30 at a given interval while a tip end 29 of the contact part 27 of the elastic contact member 20 is positioned inside and in parallel with the protecting part 37. The accommodation hole 33 is formed such that a part of the elastic contact member 20 enters accommodation hole 33 as the elastic contact member 20 is elastically deformed. When another contact contacts the contact part 27 of the elastic contact member 20 of the contact 10, the elastic contact member 20 is moved downward-and displaced, and a part of the elastic contact member 20 near the contact part 27, for example, a flat part 25, an inclined face 26 and a tip end 29 enter the accommodation hole 33.

15 Claims, 10 Drawing Sheets

CONTACT AND ELECTRIC CONNECTOR ONTO WHICH THE CONTACT IS MOUNTED

FIELD OF THE INVENTION

The invention relates to an electric connector such as a connector for use in a card, a connector for use in a printed wiring board, and the like, particularly to an improvement of bellows type contact mounted onto the electric connector.

BACKGROUND OF THE INVENTION

The connector onto which bellows type contacts have been mounted has such problems that the height of a housing of the connector (hereinafter referred to as connector housing) is substantially affected by the amount of displacement caused by the elastic deformation of the contact when each contact contacts another contact, so that there is limitation in the reduction of height of the housing in the direction of displacement of the contact, thereby enlarging an accommodating space of the connector housing so that there has been a problem of realization of a low-profile connector.

For example, FIGS. 14(A) and 14(B) and FIGS. 15(A) and 15(B) are respectively sectional views showing a connector having a housing into which a bellows type contact is mounted. The connector shown in FIGS. 14 (A) and 14 (B) is a type wherein the connector has an elastic contact 100 which is bent downward at its tip end at a given angle, and an tip end thereof enters a housing wall while the connector shown in FIGS. 15(A) and 15(B) is a type wherein a contact 200 is folded back upward and bent downward at its tip portion at a given angle.

The bellows type contact 100 shown in FIGS. 14(A) and 14(B) is made of substantially a belt-like conductive elastic contact member, and comprises a belt-like flat part 101 and a contact part 103 formed by bending the flat part 101 upward, and the tip end 105 of the contact part 103 enters the interior of a housing wall 110. The housing wall 110 is formed on both sides surfaces of an elastic contact member (one housing wall 110 alone is illustrated and the other housing wall 110 is omitted) wherein the height of each housing wall 110 is determined such that the contact 100 is displaced between the housing wall 110 and an upper face 112, and the tip end 105 is brought into contact with a bottom face 114. The length of each housing wall 110 is substantially the same length as the contact 100 in the longitudinal direction, wherein an inclination part is provided at the corner between an edge face 113 and the upper face 112 through which another contact is easily inserted.

In a state where the bellows type contact is mounted in the connector housing, the flat part 101 of the contact 100 is positioned between both housing walls 110 and the tip end 105 extended from the contact part 103 is set close to the edge face 113 of the housing wall 110, and is positioned lower than the upper face 112 (see FIG. 14(A) In this state, if another contact (not shown) provided on the printed wiring board is inserted substantially horizontally from the left side in the same figure, a tip end of another contact is brought into contact with the inclined face of the contact part 103, and it slides on the inclined face and presses the same. When another contact is further inserted or pushed inward, it displaces and moves the flat part 101 and contact part 103 downward against elasticity of the flat part 101 and contact part 103 of the contact 100 so that a flat face of another contact covers a space between both housing walls 110, and the contact part 103 is displaced until it becomes substantially flush with the same plane as the upper face 112 while the tip end 105 of the contact 100 is brought into contact with or brought close to the bottom face 114, thereby maintaining a connecting state between two contacts (see FIG. 14(B)).

Further, the bellows type contact 200 shown in FIG. 15(A) has a contact part 203 which is formed by folding back one end of a flat part 201 upward and bending downward it. Depicted by 210 is the housing wall, 211 is a bottom face, 212 is an upper face and 213 is an edge face. The contact 200 has an inclined face formed by bending the contact part 203 upward. When the contact 200 contacts another contact (not shown), a tip end of another contact is brought into contact with the inclined face and slides thereon and it displaces and moves the flat part 201 and contact part 203 downward to the bottom face 211 against an elasticity of the flat part 201 and the contact part 203 so that the end of the flat part 201 is displaced to be brought into contact with or brought close to the bottom face 211 (see FIG. 15(B)). At this time, the inclined face of the contact effects a strike preventing function relative to another contact.

With the bellows type contact having the foregoing construction shown in FIGS. 14(A) and 14(B) when another contact is inserted into the contact 100 while the tip end 105 extended from the contact part 103 is set close to the edge face 113 of the each housing wall 110 and is positioned lower than the upper face 112, the tip end of another contact is brought into contact with the inclined face of the contact 100 to effect a strike preventing function of the contact 100. That is, if the tip end 105 of the contact 100 is positioned over the housing wall 110, the tip end of another contact is brought into contact with the tip end 105 of the contact 100 when another contact is inserted into the contact 100. However, the tip end 105 is not always moved downward and there is a possibility that the tip end 105 is pushed upward. Accordingly, the contact 100 is deformed abnormally or perpetually so that a normal contact relative to another contact cannot be obtained. Therefore, it is necessary that the bellows type contact has a strike preventing function such that the tip end 105 extended from the contact part 103 is set close to the edge face 113 and it is positioned lower than the upper face 112. Accordingly, when the contact of this type is mounted in the connector housing to obtain an elastic contact pressure by deforming it elastically by a given amount of deformation, it is necessary that the height of the housing wall 110 has to meet the requirement that the tip end 105 is brought into contact with or brought close to the bottom face 114 and the contact part 103 is substantially flush with the upper face 112 of the housing wall 110. As a result, the contact 100 requires a given height, and hence when it is mounted in the connector housing, it is necessary that the housing wall 110 has a height satisfying the displacement of the contact 100, causing a problem to thin the connector.

The bellows type contact 200 shown in FIGS. 15(A) and 15(B) has the contact part 203 which is formed by folding back one end extended from the flat part 201 bending upward and bending downward it. Because of the bending portion, the reduction of height of the contact 200 has limits in the direction of displacement of the contact in the same manner as the contact 100 shown in FIGS. 14(A) and 14(B) so as to elastically deforming the contact 200 by a given amount of deformation. Accordingly, it is necessary that each housing wall has a given height when the contact is mounted in the housing, causing the same problem to thin the connector as the contact shown in FIGS. 14(A) and 14(B).

SUMMARY OF THE INVENTION

The invention has been developed to solve the foregoing problems of the prior art, and it is an object of the invention to provide a contact capable of achieving the reduction of height of the contact in a direction of displacement, and of obtaining excellent contact pressure. It is another object of the invention to provide a contact capable of achieving further reduction of height of the contact in a direction of displacement, and of obtaining excellent contact pressure. It is still another object of the invention to provide a contact capable of eliminating damage at a contact part when manufacturing the contact, of reducing the height of the contact in a direction of displacement, and of realizing the miniaturizing of the contact.

It is still further object of the invention to provide a various electric connectors wherein the contact of the invention is applied to various connectors to reduce a housing space of a connector housing, thereby realizing the low-profile connector housing.

The above object can be attained by the following means.

The contact of the invention is characterized in comprising substantially a belt-like elastic contact member having a terminal at one end and a contact part at the other end and substantially a belt-like elastic protection member having a fixing part at one end and a protecting part at the other end, wherein the elastic contact member is spaced from and disposed in parallel with the protection member at a given interval while a tip end of the contact part of the elastic contact member is positioned inside the protecting part, and a part of the elastic contact member is brought into contact with or brought close to the protection member as the elastic contact member is elastically deformed.

Further, the contact is characterized in comprising substantially a belt-like elastic contact member having a terminal at one end and a contact part at the other end and substantially a belt-like elastic protection member having a fixing part at one end, a protecting part at the other end and an accommodation hole between the fixing part and the protecting part, wherein the elastic contact member is spaced from and disposed in parallel with the protection member at a given interval while a tip end of the contact part of the elastic contact member is positioned inside the protecting part, and the accommodation hole has a size to such an extent that a part of the elastic contact member enters the accommodation hole as the elastic contact member is elastically deformed.

As an embodiment of the invention, the contact has a structure wherein the protecting part of the protection member is formed by bending a tip end of the protection member substantially in a hook shape, further, a connection part extended from the fixing part of the elastic contact member is connected to the fixing part of the protection member.

Further, the contact has a structure wherein the elastic contact member is bent substantially in a wave shape like at a portion extending from the terminal to the contact part, or the fixing part for mounting the elastic contact member in the housing is provided between the terminal and the contact part of the elastic contact member and the height of the fixing part is higher than that of the contact part.

Still further, the contact has a structure wherein the elastic contact member is formed Ad substantially flat at a portion extending from the terminal to the contact part, or a part of the elastic contact member is positioned in the accommodation hole of the protection member, or the protection member is divided symmetrically along substantially a central line thereof in a longitudinal direction.

More still further, the invention has a structure wherein the foregoing contacts are mounted onto various connectors. The electric connector is characterized in comprising a housing, through holes provided on a side wall of the housing, contact housing chamber provided in the through holes wherein any contact of the foregoing contacts is housed in each contact housing chamber to form a female socket. And, each contact housing chamber is provided on either an upper face or a lower face of each through hole, or each contact housing chamber is provided on both upper and lower faces of each through hole. Further, another electric connector is characterized in comprising a housing, a housing base part, a protruding body protruded from the housing base part, a contact housing chamber provided on the protruding body, wherein any contact of the foregoing contacts is housed in each contact housing chamber and to form a male plug. Still further, each contact housing chamber is on either an upper face or a lower face of the protruding body, or each contact housing chamber is provided on both upper and lower faces of the protruding body.

The foregoing each contact is fixed in the housing while the protection member and the elastic contact member are substantially displaced in parallel with each other or flush with each other when the contacts are mounted in the connector housing, and the tip end of the elastic contact member is disposed inside the protecting part of the protection member and it is brought into contact with or brought into close to the inner face of the protecting part. With each contact having the foregoing construction, when another contact contacts the contact part 27 of the elastic contact member, the elastic contact member is moved downward and displaced, so that a part of the elastic contact member continued from the contact part, for example, the flat part, the inclined part, the tip end enter the accommodation hole or the tip end contacts the upper face of the protection member. Accordingly, the amount of displacement of the elastic contact member is secured when another contact contacts each contact so that the height of the contact in the direction of displacement is reduced, thereby realizing a so-called low-profile contact. Further, if each contact is mounted onto various connectors, the height of each side wall of the housing space of the connector housing can be reduced, thereby realizing various low-profile connectors

BRIEF DESCRIPTION OF THE DRAWINGS

8(A) is a plan view as viewed from the above in FIG. 7, and FIG. 8(B) is a sectional view taken along the line A—A in FIG. 8(A);

FIGS. 9(A), 9(B), 9(C) and 9(D) are views showing an electric connector for use in a card to which the contact of the invention is applied, wherein FIGS. 9(A) is a front view of a female socket and 9(B) is a sectional view taken along the line A—A in FIG. 9(A), and FIG. 9(C) is a front view of a male plug and 9(D) is a sectional view taken along the line B—B in FIG. 9(C);

FIGS. 10(A) and 10(B) are views showing an electric connector to which each contact of the invention is applied wherein FIG. 10(A) is a plan view of a female socket and FIG. 10(B) is a sectional view of the female socket;

FIGS. 11(A), 11(B), 11(C), 11(D) and 11(E) are views showing an electric connector to which each contact of the invention is applied, wherein FIG. 11(A) is a front view of a male plug and 11(B) is a sectional view taken along the line A—A in FIG. 11(A), FIG. 11(C) is a front view of a female socket and FIG. 11(D) is a sectional view taken along the line B—B in FIG. 11(C) and FIG. 11(E) is a sectional view showing a state where the male plug and the female socket are coupled with each other;

FIGS. 12(A) and 12(B) are views for explaining a displacement condition of a contact of the invention in a state where the contact is mounted in a contact housing, wherein FIG. 12(A) is a sectional view before the contact is displaced and FIG. 12(B) is a sectional view after the contact is displaced;

FIGS. 13(A) and 13(B) are views for explaining a displacement condition of a contact according to another embodiment of the invention in a state where the contact is mounted in a contact housing, wherein FIG. 13(A) is a sectional view before the contact is displaced and FIG. 13(B) is a sectional view after the contact is displaced;

FIGS. 14(A) and 14(B) show a conventional contact, wherein FIG. 14(A) is a sectional view before the contact is displaced and FIG. 14(B) is a sectional view after the contact is displaced; and FIGS. 15(A) and 15(B) are show another conventional contact, wherein FIG. 15(A) is a sectional view before the contact is displaced and FIG. 15(B) is a sectional view after the contact is displaced.

PREFERRED EMBODIMENT OF THE INVENTION

Preferred embodiments of the invention are now described with reference to attached drawings. It is needless to say that the invention is not limited to the preferred embodiments described in detail hereinafter.

Figure 1:
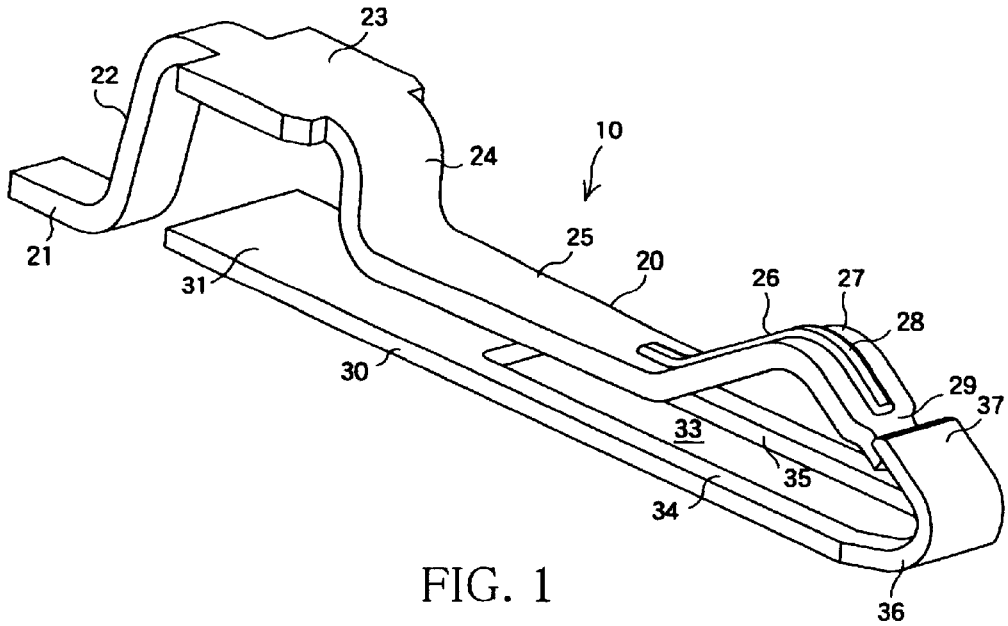
FIG. 1 is a perspective view of a contact according to a first embodiment of the invention.

FIG. 1 is a perspective view of an entire contact 10 according to a first embodiment of the invention, wherein the contact 10 is separated into an elastic contact member and a protection member having a strike preventing function. The contact 10 is molded by stamping a conductive metal plate having a given thickness and comprises substantially a belt-like elastic contact member 20 and substantially a belt-like protection member 30 paired with the elastic contact member 20. The elastic contact member 20 comprises a terminal 21 to which a lead wire and the like is connected, a rising part 22 which is raised upward from the terminal 21 and bent, and a fixing part 23 which is continued from the rising part 22 and positioned in and fixed to a housing by press-fitting and the like. The press-fitting and the like is applied to the fixing part 23 by providing a holding member (not shown) at an end side of the fixing part 23 at one side or both sides of the attachment fixing part 23 in width direction. The contact 10 has a bent part 24 which is continued from the fixing part 23, a flat part 25 and an inclined face 26, a contact part 27 and a tip end 29, which are continued from the flat part 25.

The elastic contact member 20 is formed when molded such that the fixing part 23 is slightly higher than the contact part 27, and it is bent substantially in a wave shape near the terminal 21, the contact part 27 near the tip end 29 so as to obtain a given elasticity when it contacts another contact. The reason why the fixing part 23 is slightly higher than the contact part 27 is to prevent the collision or striking between the contacts caused by the lamination of multiple contacts which are picked up when they are stamped and bent. However, since the fixing part 23 is slightly higher than the contact part 27, the striking between the contacts can be received or absorbed by the fixing part 23 so that the striking between the contact parts 27 is changed to the striking between the fixing parts 23, thereby avoiding the strong striking between the contact parts 27, so that abnormal deformation of the contact parts 27 can be prevented. Further, the elastic contact member 20 is formed to be narrower in its width as it directs from the flat part 25 toward the inclined face 26, the contact part 27 and the tip end 29, thereby easily accommodating them into an accommodation hole of a protection member, described later. The width of the elastic contact member 20 is determined relative to a width of the accommodation hole of the protection member. If the width of the accommodation hole is larger than that of the elastic contact member 20, it is not necessary to narrow the width of the elastic contact member 20. Further, the contact part 27 has a protrusion part 28 provided at a part of the central portion of the front face thereof in the longitudinal direction. The protrusion part 28 is arbitrarily provided, as necessary, and it is provided in the first to sixth embodiments, as necessary. The protrusion part 28 has a function to obtain an excellent electric contact pressure relative to another contact, and it is formed by protruding the elastic contact member 20 from the rear face upward by extrusion molding.

The member having a strike preventing function, a so-called protection member 30 is substantially belt-like, and paired with the elastic contact member 20, and it has the same width as or slightly wider than that of the elastic contact member 20, and a length which is slightly shorter than the elastic contact member 20. The accommodation hole 33 through which a part of the elastic contact member 20 enters is formed in the protection member 30 at a portion extending from substantially a middle portion to a tip end in the longitudinal direction. The accommodation hole 33 is surrounded by the flat part 31, a pair of arms 34, 35 and a protecting part 37. The tip end of the protecting part 37 is folded at a given angle to form a bent part 36 which is bent substantially in a hook shape and the protecting part 37. The contact 10 is separated into the elastic contact member 20 and the protection member 30, and has less bent portion and hence, the stamping or bending and machining of the metallic plate is simple, thereby easily manufacturing the contact. It is possible to provide a holding member (not shown) such as a protrusion and the like on the end side of the belt-like flat part 31 in the width direction, thereby achieving the pressure mounting in the housing.

When the contact 10 is mounted in the connector housing, the elastic contact member 20 is disposed over the protection member 30 substantially in parallel therewith, and the tip end 29 of the elastic contact member 20 is disposed inside the protecting part 37 of the protection member 30 so that the tip end 29 is brought into contact with or brought close to the inner face of the protecting part 37, and then the contact 10 is fixed to the housing. With a construction of the contact 10, when another contact (not shown) contacts the contact part 27 of the elastic contact member 20 of the contact 10, the elastic contact member 20 is moved and displaced downward, so that a part of the elastic contact member 20 continued from the contact part 27, for example, the flat part 25, the inclined face 26 and the tip end 29 enter the accommodation hole 33, thereby ensuring the amount of displacement of the elastic contact member 20 when another contact contacts the elastic contact member 20. With such a construction, the contact 10 becomes low in height in the direction of displacement, namely, the reduction of height can be achieved, and also the height of each wall of the housing space in which the contact 10 is mounted can be reduced, so that the low-profile contact can be realized.

Figure 2:
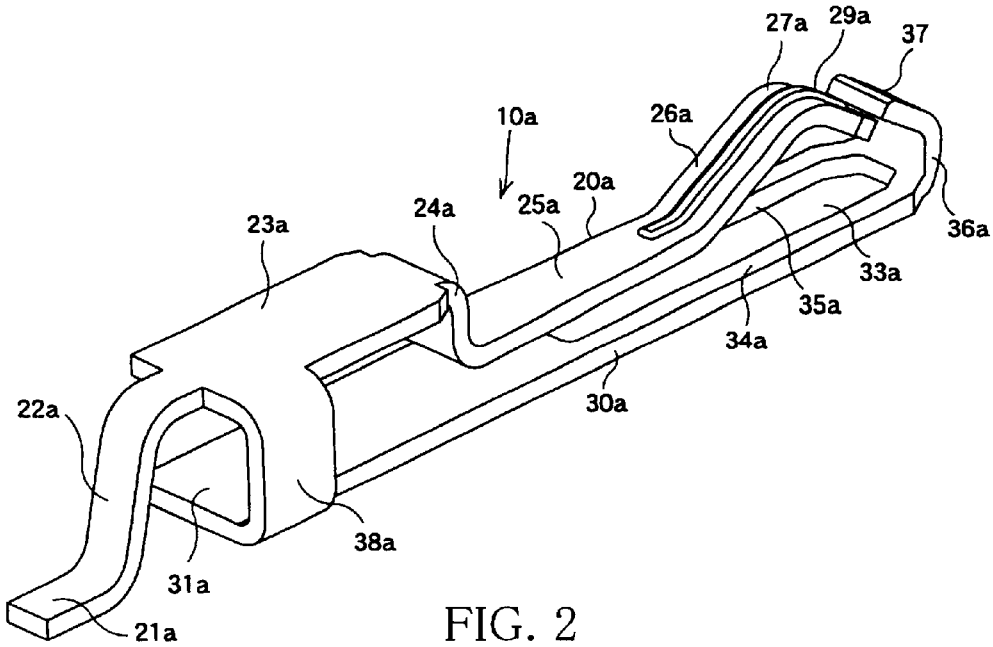
FIG. 2 is a perspective view of a contact according to a second embodiment of the invention.

FIG. 2 is a perspective view showing an entire contact according to a second embodiment of the invention. A contact 10*a* has substantially the same construction as the contact 10 in FIG. 1 and comprises an elastic contact member 20*a* and a protection member 30*a*. Members 21*a* to 29*a* constituting the elastic contact member 20*a* correspond to the members 21 to 29 of the elastic contact member 20 in FIG. 1 and members 31*a* to 37*a* of the protection member 30*a* correspond to the members 31 to 37 of the protection member 30 in FIG. 1. Since these corresponding members have substantially the same construction and same function, detailed description thereof is omitted. The contact 10*a* is different from the contact 10 in FIG. 1 in that the contact 10*a* has a connection cart 38*a* between the elastic contact member 20*a* and protection member 30*a* to integrally connect them although the elastic contact member 20 and the protection member 30 in FIG. 1 is separately provided. The connection part 38*a* is formed by stamping a thin metallic plate provided with a member corresponding to the connection part 38*a* in advance. Since the contact 10*a* is formed by integrally connecting the elastic contact member 20*a* and protection member 30*a* with each other, the contact 10*a* can be easily manufactured, and the parts of the contact 10*a* can be controlled without taking time and labor in administrating products, and the contact 10*a* is simplified in construction compared with the contact which is mounted in the housing while provided with the elastic contact member 20 and protection member 30 separately. Since other functions of the contact 10*a* are the same as those of the contact 10, the explanation thereof is omitted.

Figure 3:
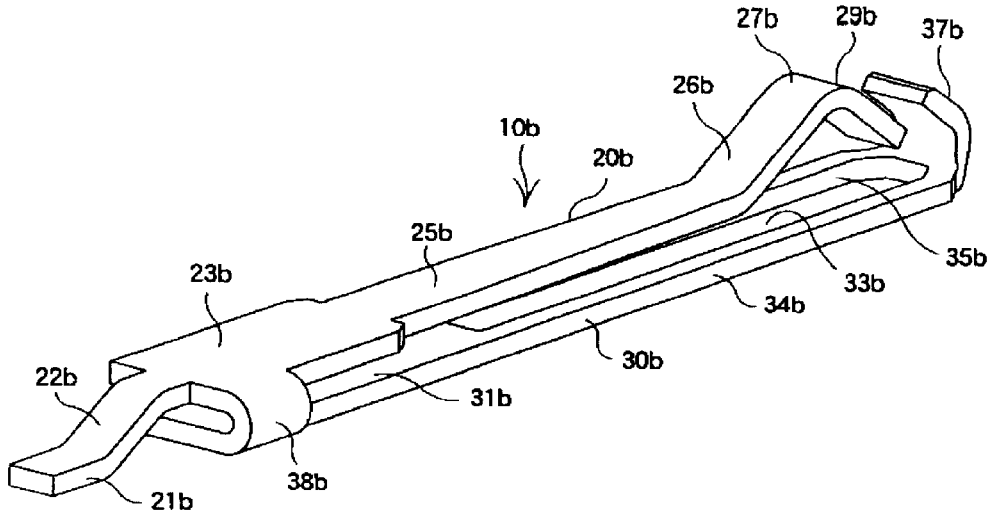
FIG. 3 is a perspective view of a contact according to a third embodiment of the invention.

FIG. 3 is a perspective view showing an entire contact according to a third embodiment of the invention. A contact 10*b* has substantially the same construction as the contact 10*a* of the second embodiment, and the former is different from the latter such that a bent part (corresponding to the bent part 24*a* in FIG. 2) of an elastic contact member 20*b* of the third embodiment is made flat. That is, when the bent part 24*a* in FIG. 2 is made flat, the length of a connection part 38*b* is made short, and a fixing part 23*b* and a flat part 25*b* are positioned substantially to be flush with each other. Further, an accommodation hole 33*b* of a protection member 30*b* is extended to a position close to a fixed part 31*b* to lengthen the accommodation hole 33*b*. Since the length of the accommodation hole 33*b* is made longer, it can accommodate more parts of the elastic contact member 20*b* compared with the contact 10*a* in the second embodiment, so that the height of the contact 10*b* can be more reduced in the direction of displacement.

Figure 4:
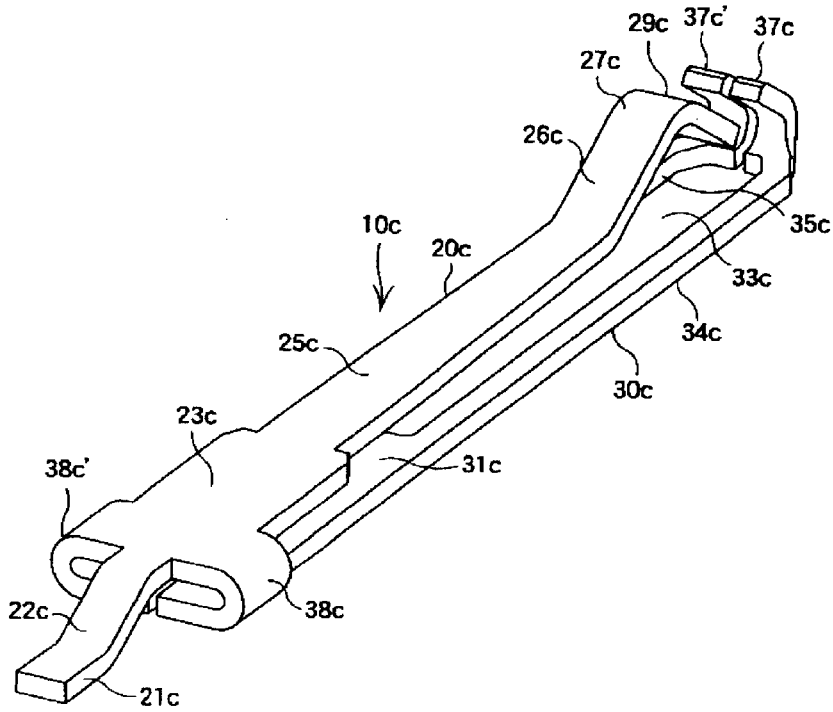
FIG. 4 is a perspective view of a contact according to a fourth embodiment of the invention.

FIG. 4 is a perspective view showing an entire contact according to a fourth embodiment of the invention. A contact 10*c* has substantially the same construction as the contact 10*b* of the third embodiment, and the former is different from the latter in that a protection member 30*c* is divided substantially symmetrically along the center line in the longitudinal direction. That is, the protection member 30*c* is divided into a pair of fixing parts 31*c*, a pair of arms 34*c*, 35*c*, and a pair of protecting parts 37*c*, 37*c*', while an accommodation hole 33*c* is formed therebetween, and a fixing part 23*c* and the pair of fixing parts 31*c* are connected with each other by a pair of connection parts 38*c*, 38*c*'. Since the pair of connection parts 38, 38' are respectively formed on both sides of the contact 10*c* in the longitudinal direction, the connection between an elastic contact member 20*c* and the protection member 30*c* is stabilized compared with the contact having one connection part 38*a* or 38*b* shown in FIGS. 2 and 3, thereby improving the reliability of the contact.

Figure 5:
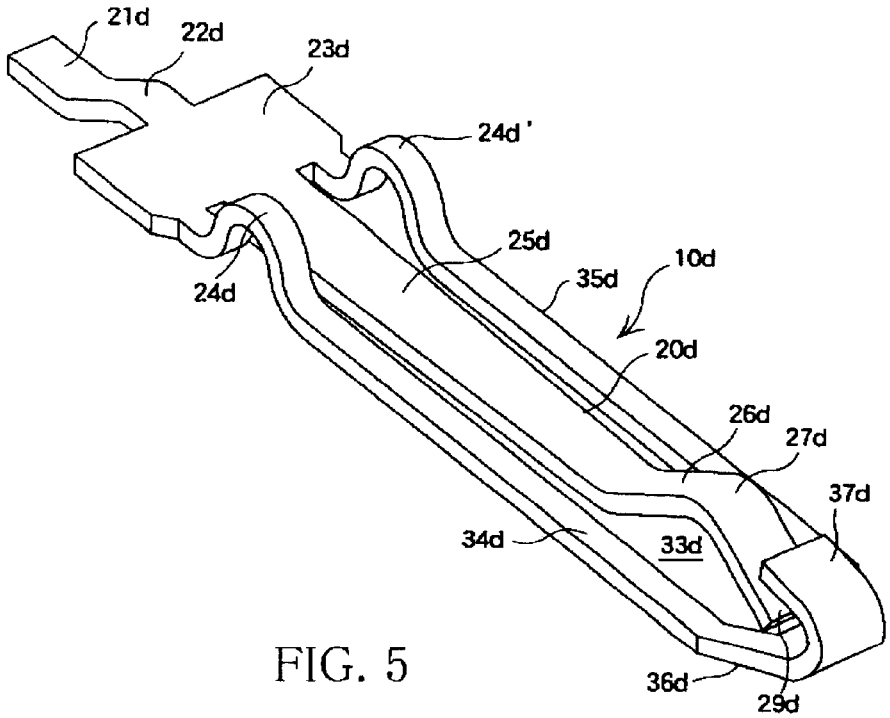
FIG. 5 is a perspective view of a contact according to a fifth embodiment of the invention.

FIG. 5 is a perspective view showing an entire contact according to a fifth embodiment of the invention. A contact 10*d* is different from the contact 10*a*, 10*b* of the second and third embodiments in respect of the constructions of a fixing part 23*d*, a pair of arms 34*d*, 35*d* and an accommodation hole 33*d*. That is, the pair of arms 34*d*, 35*d* are extended from the fixing part 23*d*, and they are bent in the shape of wave at the portion close to the fixing part 23*d* to form bent parts 24*d*, 24*d*'. The tip ends of these bent parts 24*d*, 24*d*' are integrally connected each other to form a protecting part 37*d*, and the accommodation hole 33*d* is positioned between the pair of arms 34*d*, 35*d*. According to the contact 10*d* of the fifth embodiment, an elastic contact member 20*d* always enters the accommodation hole 33*d* even if it does not contact another contact. Since the elastic contact member 20*d* and the protecting part 37*d* are integrally connected each other according to the contact 10*d* of the fifth embodiment, the number of folded parts is reduced, thereby reducing the number of manufacturing steps, so that the contact can be easily manufactured. Further, since the elastic contact member 20*d* enters the accommodation hole 33*d*, the reduction of height of contact can be further enhanced.

Figure 6:
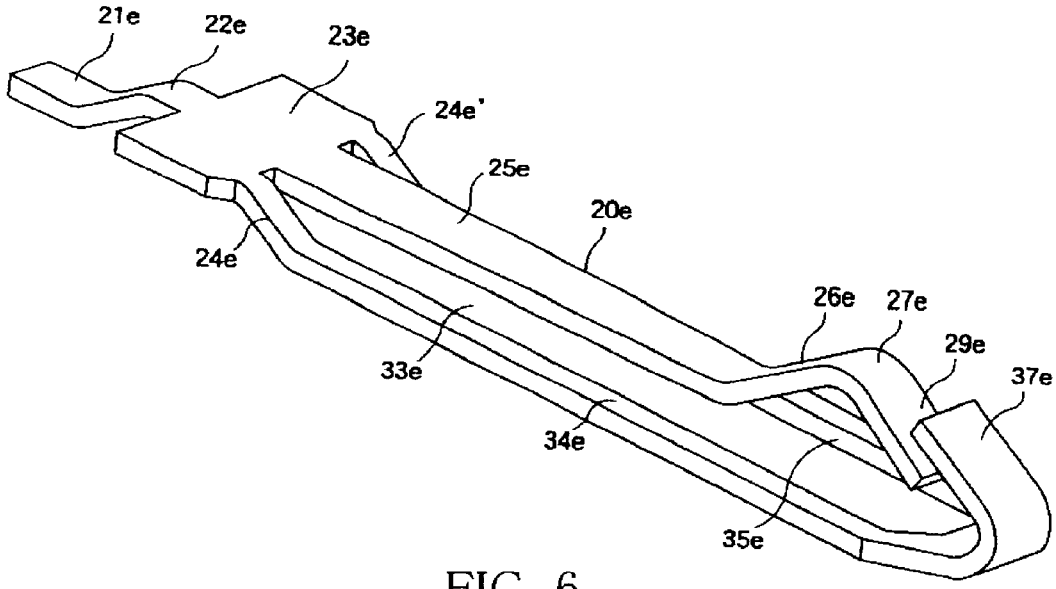
FIG. 6 is a perspective view of a contact according to a sixth embodiment of the invention.

FIG. 6 is a perspective view showing an entire contact according to a sixth embodiment of the invention. A contact has substantially the same construction as the contact 10*d* of the fifth embodiment, and the former is different from the latter in that a bending direction of a pair of bent parts of the former is different from that of the latter. That is, a pair of arms 34*e*, 35*e* are extended from the fixing part 23*e*, and they are bent downward at the portion close to the fixing part 23*e* to form bent parts 24*e*, 24*e*'. The tip ends of these bent parts 24*e*, 24*e*' are integrally connected to each other to form a protecting part 37*e*, and the accommodation hole 33*e* is positioned between the pair of arms 34*e*, 35*e*. The contact of the sixth embodiment is also can be easily manufactured like the fifth embodiment, and the reduction of height of contact can be also further enhanced.

Although contacts as shown in FIGS. 1 to 6 have respectively accommodation hole provided in the protection members, they effect the same function as the accommodation holes while dispensing with the accommodation holes depending on the application of the contacts to various connectors. That is, particularly the contacts as shown in FIGS. 1 to 4 are formed without providing the accommodation holes in the protection members. If the accommodation hole is not provided in the contact, a part of the elastic contact member is brought into contact with or brought close to the flat face of the protection member when the contact contacts another contact. However, although the amount of displacement of the elastic contact member is slightly smaller than that of the contact provided with the accommodation hole, the reduction of height of the contact in the direction of displacement can be achieved.

Complementarily described with reference to FIGS. 12 to 15 is the reduction of height of contacts in the direction of displacement by comparing the contacts as shown in FIGS. 1 to 6 with the conventional contacts. FIGS. 12(A) and 12(B) show a contact having an accommodation hole provided in a protection member, and FIGS. 13(A) and 13(B) show a contact having no accommodation hole in a protection member, wherein FIG. 12(A) and FIG. 13(A) are sectional views showing a state before another contact is inserted into the contact which is mounted in the housing and FIG. 12(B) and FIG. 13(B) are sectional views showing a state after another contact is inserted into the contact. The contacts shown in FIGS. 14(A) and 14(B) and FIGS. 15(A) and 15(B) are conventional ones which has been already described in detail. Described first is the contact 10 shown in FIG. 1 of the contacts having the contact holes provided in the protection members shown in FIGS. 1 to 6. In a state before another contact (not shown) is inserted into the contact (see FIG. 12(A)), when another contact is inserted substantially horizontally from left side in the same figure, both the elastic contact member 20 and protection member 30 are moved and displaced until they substantially flush with an upper face 43 of the housing wall. This displacement is achieved when the tip end 29, the inclined face 26, and the part of the flat part 25 of the elastic contact member 20 enter the accommodation hole 33 of the protection member 30.

Figure 12A:
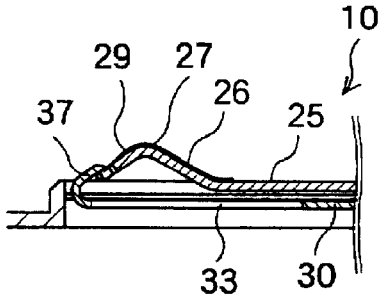
Figure 12B:
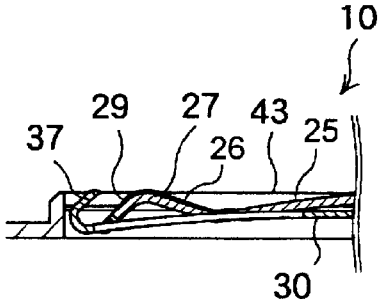
Figure 14A:
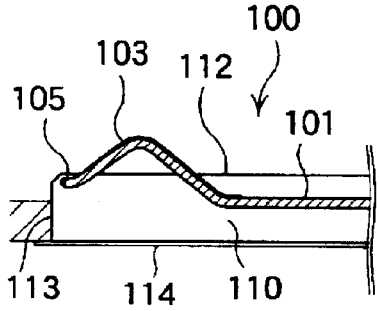
Figure 14B:
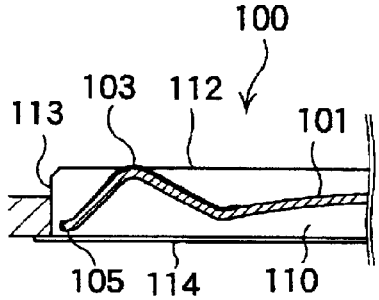
Figure 15A:
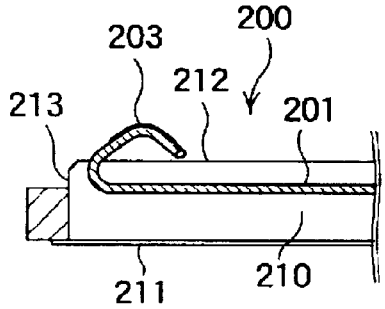
Figure 15B:
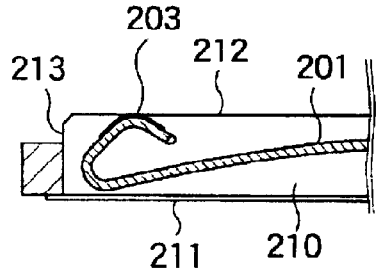

If these states, namely, the state before the card is inserted (see FIG. 12(A)) and the state after the card is inserted whereby the elastic contact member 20 is displaced so that the part of the elastic contact member 20 enters the accommodation hole 33 of the protection member 30 (see FIG. 12(B)) are compared with the same states of the conventional contacts (see FIG. 14(B), FIG. 15(B),) it is understood that the reduction of height of the contact 10 is enhanced when it is displaced, thereby lowering the height of the contact housing side wall accompanied thereby, and realizing a low-profile connector. The contacts shown in FIGS. 2 to 6 operate in the same manner as the contact shown in FIG. 1, namely, when the contacts shown in FIGS. 2 to 6 contact another contact, a part of the elastic contact member 20 enters the accommodation hole of the protection member, thereby achieving the reduction of height of the contact.

Figure 13A:
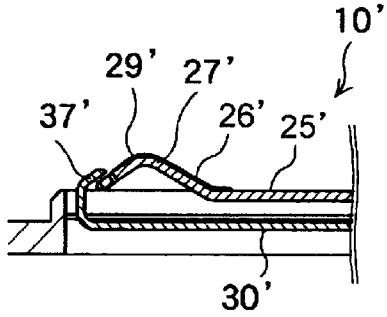
Figure 13B:
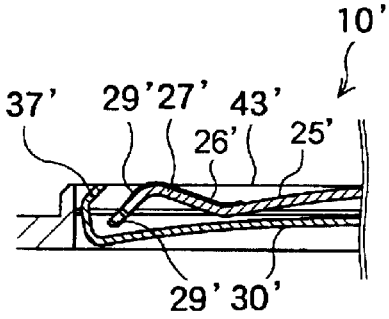

In the case of contact having no accommodation hole in the protection member as shown in FIGS. 13(A) and 13(B), when the contact shown in FIG. 13(B) contacts another contact, a tip end 29' of a contact 10' is brought into contact or brought close to the upper face of a protection member 30'. Depicted by 27' is a contact part and 37' is a protecting part. Although the amount of displacement of the elastic contact member of the contact 10' is slightly smaller than that of the contact provided with the accommodation hole, the reduction of height of the contact in the direction of displacement can be achieved, and further, the height up to the upper face 43' of the contact housing part can be reduced, thereby realizing a low-profile connector.

Described next is an application of the contact 10 in the first embodiment in FIG. 1 to a connector of the contacts shown in FIGS. 1 to 6. Although other contacts shown in FIGS. 2 to 6 are different from the contact 10 shown in FIG. 1 in respect of the detailed construction, connector housings are changed in shapes, dimensions and the like based on the difference of the construction of contacts shown in FIGS. 2 to 6, and such changes can be effected depending on designs thereof, namely, connector housings are changed every time the designs are changed, and hence the explanation thereof is omitted. Further, although the contacts shown in FIGS. 1 to 6 have accommodation holes provided in the protection members, contact having no accommodation hole can be also applied to a connector.

Figure 7:
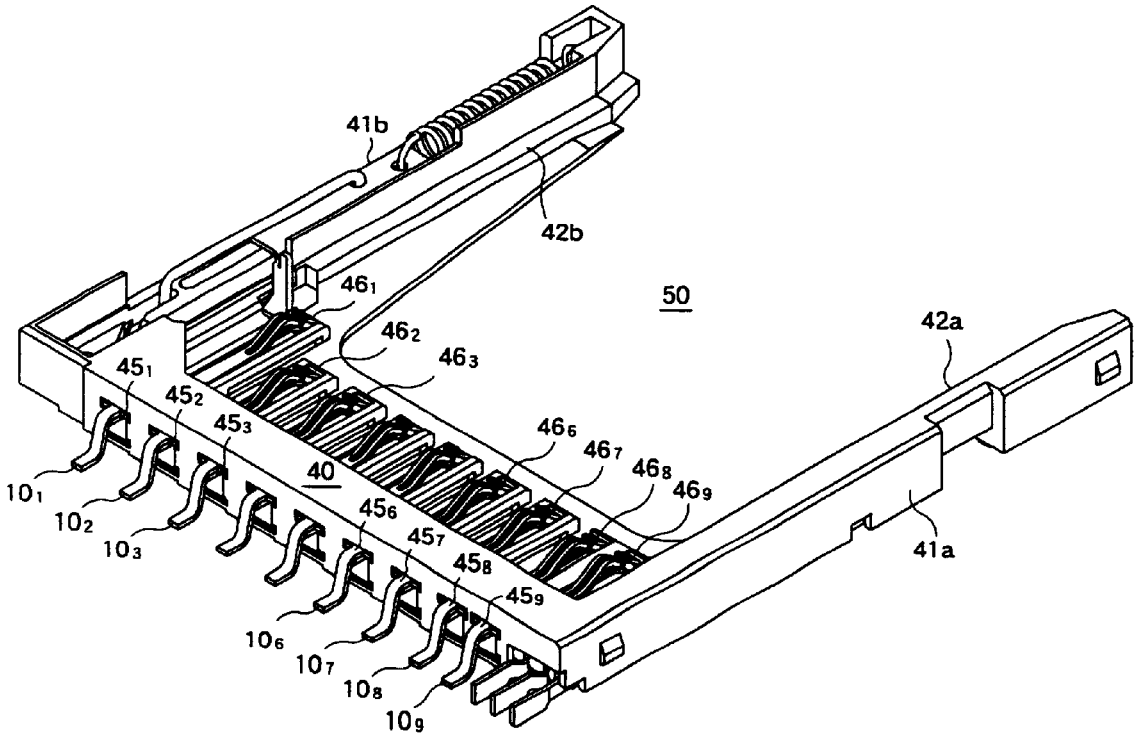
FIG. 7 is a perspective view showing an external appearance of an electric connector for use in a card to which each contact of the invention is applied, wherein each contact is mounted onto the electric connector while a cover is removed from the electric connector.
Figure 8A:
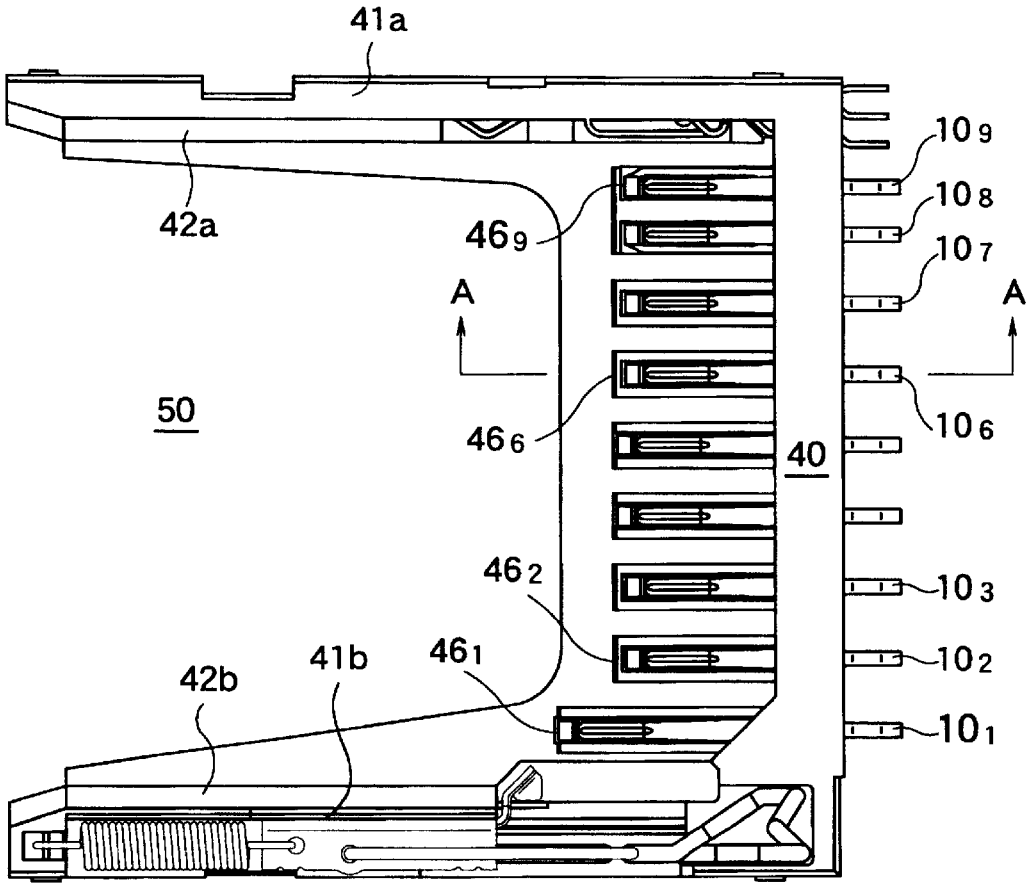
FIGS. 8(A) and 8(B) are views showing an external appearance of an electric connector for use in a card to which each contact of the invention is applied, wherein FIG.
Figure 8B:
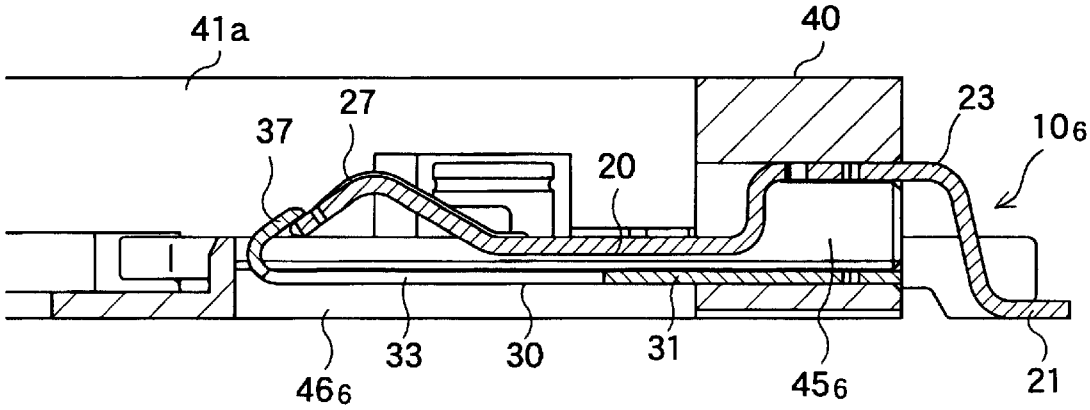

The multiple contacts are first applied to a connector for use in a card, for example, as shown in FIGS. 7 to 8. FIG. 7 is a perspective view showing an external appearance of an electric connector for use in a card to which the contact of the invention is applied wherein the contacts are mounted onto the electric connector while a cover is removed from the electric connector, and FIGS. 8(A) and 8(B) are perspective views showing an external appearance of an electric connector for use in a card to which the contact of the invention is applied, wherein FIG. 8(A) is a plan view as viewed from the above in FIG. 7, and FIG. 8(B) is a sectional view taken along line A—A in FIG. 8(A). The construction of the connector of this type for use in a card comprises a pair of side rails 41*a*, 41*b* which are opposite to each other, a bay 50 between the opposite pair of side rails 41*a*, 41*b*, a frame 40 formed by connecting both ends of the side rails 41*a*, 41*b*, multiple through holes 451 to 459 through which multiple contacts 101 to 109 are inserted and which are spaced from one another, and contact accommodation spaces 461 to 469 which accommodate the multiple contacts 101 to 109 and communicate with the multiple through holes 451 to 459. Grooves 42*a*, 42*b* are formed in the inner faces of the side rails 41*a*, 41*b* and a card (not shown) is guided and inserted along these grooves so that contacts disposed on the lower face of the card contact the contacts disposed in the contact accommodation spaces 461 to 469. The frame and the like constituting the connector are already known, and hence the explanation thereof is omitted.

The multiple contacts 101 to 109 are respectively mounted on this connector. Described next is one of the contacts, i.e., the contact 106. The connector housing has the through hole 456 provided in the frame 40 through which the contact 106 is inserted, and the contact accommodation space 466 in which the contact 106 is accommodated, wherein the contact accommodation space 466 has side walls which are surrounded by a wall at the peripheries and arranged along a longitudinal direction of the contact 106 (one side wall is shown in FIG. 8(B)) and an end wall at the side opposite to the through hole 456, and it is opened at the upper and lower faces forming a space where the contact 106 can be moved up and down and displaced therein.

First, the protection member 30 is inserted into the through hole 456 with the protecting part 37 in the lead, and the protection member 30 is fixed to the bottom face of the through hole 456 by press-fitting and the like. Subsequently, the elastic contact member 20 is inserted into the through hole 456 with the tip end 29 in the lead while the flat part 25 is fin fixed to the upper face of the through hole 456 of the housing in the same manner, thereafter the tip end 29 of the contact part 27 of the elastic contact member 20 is brought into contact with or brought close to the inner face of the protecting part 37. With the contact having the elastic contact member and the protection member which are coupled with each other, both the elastic contact member and the protection member are inserted into the through hole at the same time and fixed thereto.

If another contact (not shown) is inserted substantially horizontally from left side in FIG. 8(B), the tip end of another contact first contacts the inclined face of the protecting part 37 of the protection member 30, then moves on the inclined face of the protecting part 37, subsequently, it is brought into contact with the inclined face of the contact part 27 of the elastic contact member 20, then moves on the inclined face of the contact part 27, thereafter it moves and displaces the protection member 30 and elastic contact member 20 downward against an elasticity thereof so that a flat face of another contact covers a space between both side walls of the housing, and another contact contacts the contact part 27, thereby completing an electric connection between another contact and the contact 106. As a result, the reduction of height of the contact in the direction of displacement and the reduction of a contact housing space are achieved, for example, as explained with reference to the contact shown in FIG. 12.

Figure 9A:
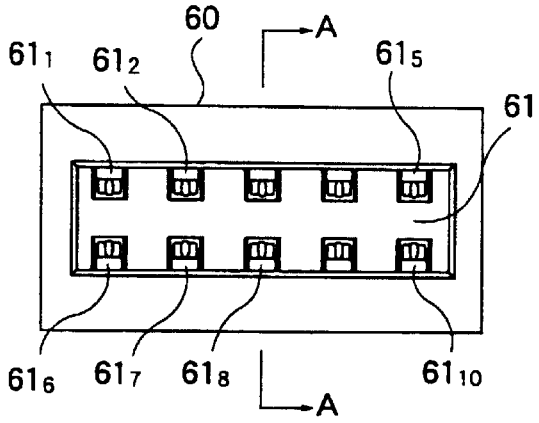
Figure 9C:
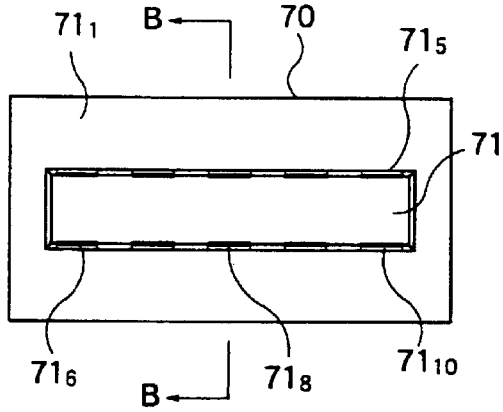
Figure 9B:
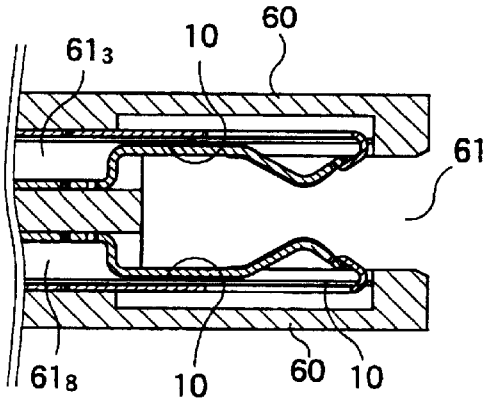
Figure 9D:
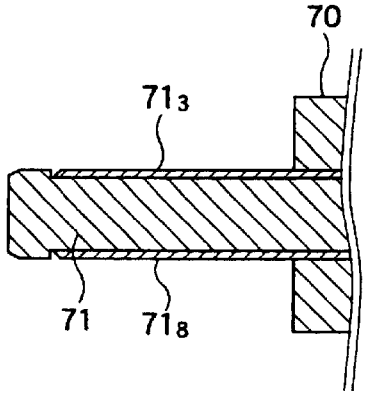

The contact shown in FIGS. 1 to 6 are used, for example, in a connector shown in FIGS. 9(A), 9(B), 9(C) and 9(D). FIGS. 9(A) and 9(B) show a female socket, and FIGS. 9(C) and 9(D) show a male plug to be coupled with the female socket, wherein FIG. 9(A) is a front view, FIG. 9(B) is a sectional view taken along the line A—A in FIG. 9(A), FIG. 9(C) is a front view and FIG. 9(D) is a sectional view taken along B—B in FIG. 9(C). A female socket 60 has substantially a box shape to form a housing, wherein an opening 61 provided in the front face and multiple through holes 611 to 6110 bored in the female socket 60 and provided on the upper and lower portions of the opening 61 in the longitudinal direction thereof through which contacts 10 are inserted and fixed therein. Further, the opening 61 has spaces at the upper and lower inner faces thereof through which the contacts are elastically deformed. The contacts 10 are respectively inserted into and fixed to the through holes 611 to 6110, thereby forming the female socket (see FIG. 9(B)). A male plug 70 has a structure provided with a protrusion 71 having a given thickness and flat shape and multiple contacts 711 to 7110 disposed on a flat face of the flat part of the protrusion 71. When the female socket 60 and the male plug 70 are coupled with each other, each contact part of the contact 10 is pressed by the tip end of the male plug 70 so that a part of the elastic contact member enters the accommodation hole of the protection member. As a result, excellent connection between the contact 10 and the contact shown in FIGS. 9(A) to 9(D) is effected. Even in this connector shown in FIGS. 9(A) to 9(D), the height of each side wall of the connector housing can be reduced in the same manner as the electric connector as shown in FIGS. 7, 8(A) and 8(B), thereby realizing a low-profile connector.

Figure 10A:
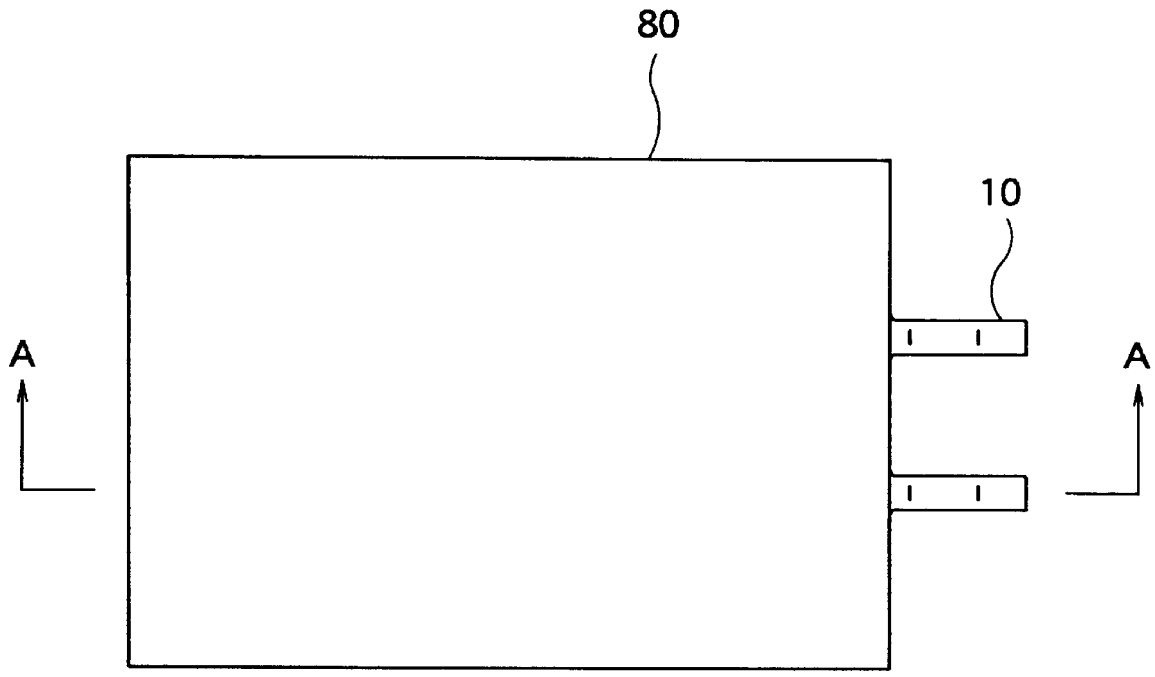
Figure 10B:
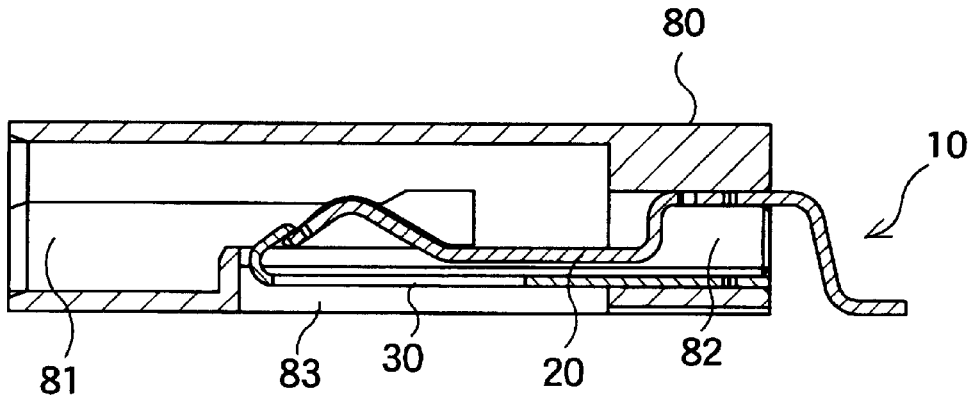

Further, the contact shown in FIGS. 1 to 6 are used, for example, in a female socket shown in FIGS. 10(A) and 10(B). FIG. 10(A) is a plan view of the female socket and FIG. 10(B) is a sectional view taken along the line A—A in FIG. 10(A). A female socket 80 has substantially a box shape and has through holes 81, 82 which penetrate the female socket 80 from one end to the other end thereof, and an accommodation part 83 for accommodating a contact therein, wherein the accommodation part 83 is opened toward a bottom face or closed to form a space where a contact can be displaced therein. The contact 10 is inserted into the through hole 82 while the contact part thereof is directed above, and the elastic contact member 20 and the protection member 30 are mounted on the upper and lower faces of the through hole 82, thereby assembling the female socket 80 (see FIG. 10(B)). The function of the contact 10 when another contact (not shown) is inserted into the female socket 80 in this state is the same as that when the contact 10 is mounted in the housing, and hence the explanation thereof is omitted.

Figure 11A:
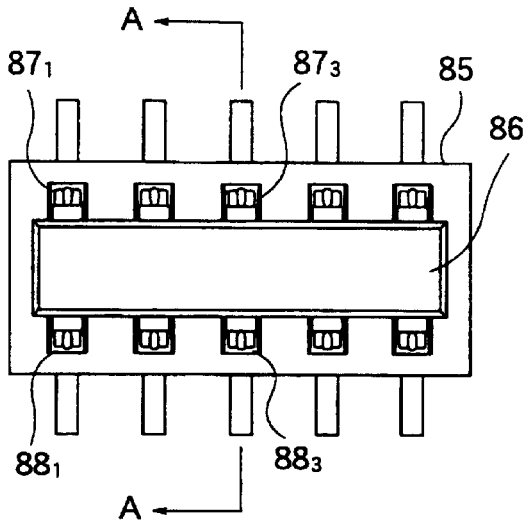
Figure 11C:
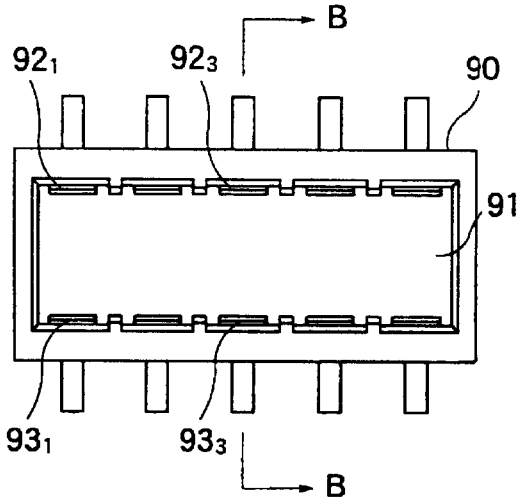
Figure 11B:
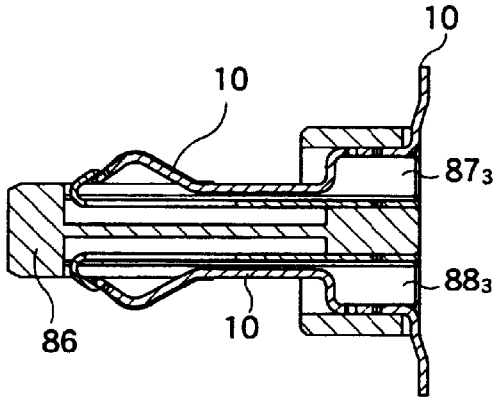
Figure 11D:
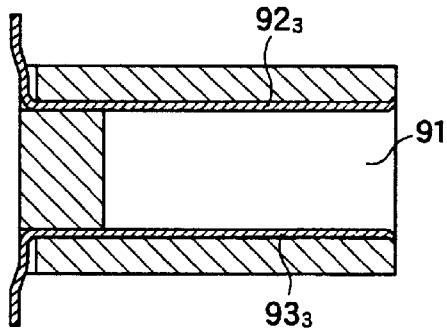
Figure 11E:
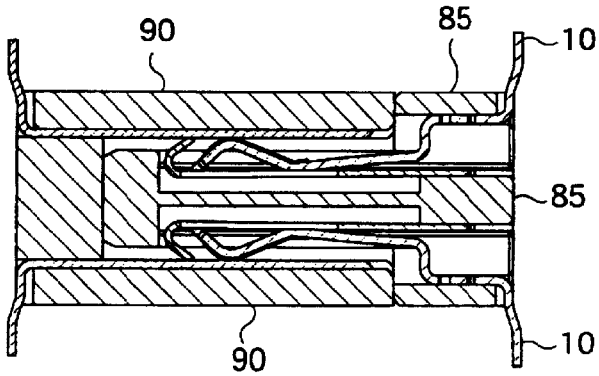

Still further, the contacts shown in FIGS. 1 to 6 are used, for example, in a connector shown in FIGS. 11(A) to 11(E). FIGS. 11(A), 11(B), 11(C), 11(D) and 11(E) show a pair of male plugs and female sockets, wherein FIG. 11(A) is a front view of the male plug and 11(B) is a sectional view taken along line A—A in FIG. 11(A), FIG. 11(C) is a front view of the female socket and 11(D) is a sectional view taken along the line B—B in FIG. 11(C) and FIG. 11(E) is a sectional view showing a state where the male plug and the female socket are coupled with each other. The male plug has a protrusion 86 which protrudes forward from a housing part 85 having multiple through holes 871, 873, 881, 883 which are provided therein and positioned up and down opposite to each other through which the contacts 10 are inserted. These through holes have grooves at the upper and lower portions through which the contacts 10 are positioned and fixed therein. Further, the male plug has an accommodation space for accommodating the contacts therein, to form contact accommodation chambers in which the contacts 10 are displaced (see FIGS. 11(A) and 11(B)). Meanwhile, the female plug has a box shape and a through hole 91 provided therein through which the protrusion 86 of the male plug is inserted. Contacts 921, 923, 931, 933 are disposed on the upper and lower inner faces of the through hole 91 at a given interval (see FIGS. 11(C) and 11(D)). When the male plug and female socket are coupled with each other, the contact 10 of the male plug contacts the contact of the female socket, thereby completing the connection. At this time, a.part of the elastic contact member of the contact 10 enters the accommodation hole of the protection member. As a result, an excellent contact between the contact and the elastic contact member can be maintained with an appropriate contact pressure, thereby realizing a low-profile male plug, and also realizing a low-profile female socket, accompanied thereby.

With each contact having the foregoing construction as mentioned in detail above, since a part of the elastic contact member enters or contacts the accommodation hole of the protection member when it contacts another contact, the height of the contact in the direction of displacement is reduced, thereby realizing a so-called low-profile contact. Further, since the contact of the invention has less bent portions, and it is simplified in construction so that the contact can be small-sized and easily manufactured. Still further, since the height of the fixing part is higher than the height of the contact part, the contact part can be prevented from being damaged when manufacturing the contact. More still further, the contact achieving the reduction of height thereof can be applied to various connectors, thereby realizing various low-profile connectors.

What is claimed is:

1. A contact comprising substantially a belt-like elastic contact member having a terminal at one end and a contact part at the other end and substantially a belt-like elastic protection member having a fixed part at one end and a protecting part at the other end, wherein the elastic contact member is spaced from and disposed in parallel with the protection member at a given interval while a tip end of the contact part of the elastic contact member is positioned inside the protecting part, and a part of the elastic contact member is brought into contact with or brought close to the protection member as the elastic contact member is elastically deformed.

2. A contact comprising substantially a belt-like elastic contact member having a terminal at one end and a contact part at the other end and substantially a belt-like elastic protection member having a fixed part at one end, a protecting part at the other end and an accommodation hole between the fixed part and the protecting part, wherein the elastic contact member is spaced from and disposed in parallel with the protection member at a given interval while a tip end of the contact part of the elastic contact member is positioned inside the protecting part, and the accommodation hole has a size to such an extent that a part of the elastic contact member enters the accommodation hole as the elastic contact member is elastically deformed.

3. The contact according to claim 1 or 2, wherein the protecting part of the protection member is formed by bending a tip end of the protection member substantially in a hook shape.

4. The contact according to any of claims 1 to 2, wherein the fixed part of the elastic contact member is connected to the fixing part of the protection member.

5. The contact according to any of claims 1 to 2, wherein the elastic contact member is bent substantially in a wave shape like at a portion extending from the terminal to the contact part.

6. The contact according to claim 5, wherein the attachment fixing part is provided between the terminal and the contact part of the elastic contact member and the height of the attachment fixing part is higher than that of the contact part.

7. The contact according to any of claims 1 to 2, wherein the elastic contact member is formed substantially flat at a portion extending from the terminal to the contact part.

8. The contact according to claim 2, wherein at least the contact part of the elastic contact member is positioned in the accommodation hole of the protection member.

9. The contact according to any of claims 1 to 2, wherein the protection member is divided symmetrically along substantially a central line thereof in a longitudinal direction, so that both half parts of the protection member are connected to the elastic contact member respectively.

10. An electric connector comprising a housing, through holes provided on a side wall of the housing, contact housing chamber provided in the through holes wherein the contact according to any of claims 1 to 2 is housed in each contact housing chamber to form a female socket.

11. The electric connector according to claim 10, wherein each contact housing chamber is provided on either an upper face or a lower face of each through hole.

12. The electric connector according to claim 10, wherein each contact housing chamber is provided on both upper and lower faces of each through hole.

13. An electric connector comprising a housing, a housing base part, a protruding body protruded from the housing base part, a contact housing chamber provided on the protruding body, wherein the contact according to any of claims 1 to 2 is housed in each contact housing chamber and to form a male plug.

14. The electric connector according to claim 13, wherein each contact housing chamber is on either an upper face or a lower face of the protruding body.

15. The electric connector according to claim 13, wherein each contact housing chamber is provided on both upper and lower faces of the protruding body.

* * * * *